313-414 SR
8/24/82 XR 4,346,327

United States Patent [19]
Barten

[11] 4,346,327
[45] Aug. 24, 1982

[54] DISPLAY TUBE FOR DISPLAYING COLOR PICTURES

[75] Inventor: Piet G. J. Barten, Eindhoven, Netherlands

[73] Assignee: U.S. Philips Corporation, New York, N.Y.

[21] Appl. No.: 9,580

[22] Filed: Feb. 5, 1979

[30] Foreign Application Priority Data

Feb. 27, 1978 [NL] Netherlands ..... 7802129

[51] Int. Cl.[3] ..... H01J 29/51; H01J 29/76
[52] U.S. Cl. ..... 313/413; 313/414
[58] Field of Search ..... 313/413, 409, 414, 412

[56] References Cited

U.S. PATENT DOCUMENTS 3,772,554 11/1973 Hughes ..... 313/412
3,866,080 2/1975 Barkow ..... 313/412
3,984,723 10/1976 Gross et al. ..... 313/412
4,057,747 11/1977 Hamand ..... 313/413

*Primary Examiner*—Palmer C. Demeo
*Attorney, Agent, or Firm*—Thomas A. Briody; William J. Streeter; Laurence A. Wright

[57] ABSTRACT

Because the deflection fields in color television display tubes on the display screen side often have a pin-cushion-shaped and barrel-shaped field distribution, a defocusing of the electron beams occurs upon deflection. By forming the barrel-shaped deflection field on the display screen side of the display tube so as to be pin-cushion-shaped on the neck side near each electron beam and simultaneously deforming the deflection field which is pin-cushion-shaped on the display screen side of the display tube so as to be barrel-shaped on the neck side near each electron beam, the effects of said defocusing of the electron beams as a result of the deflection are considerably reduced. The haze occurring in the vertical direction is also reduced.

6 Claims, 19 Drawing Figures

DISPLAY TUBE FOR DISPLAYING COLOR PICTURES

BACKGROUND OF THE INVENTION

The invention relates to a display tube for displaying color pictures comprising a display window, a cone and a neck, a display screen, provided on the inside of the display window, comprising a large number of regions luminescing in three different colors, means provided in the neck for generating three electron beams, the beam axes of which are situated substantially in one plane, a color selection electrode positioned before the display screen which assigns each electron beam to luminescent regions of one color, the generating means being provided, on the display screen side, with correction elements placed near each beam, wherein the display tube is meant to cooperate with a system of deflection coils around the transition neck-cone of the display tube to generate a first and a second deflection field, which deflection fields are orthogonal, and the distribution of the first deflection field, on the display screen side, is strongly pin-cushion-shaped and the distribution of the second deflection field, on the display screen side, is strongly barrel-shaped.

Such a display tube is known from the article "Large screen colour television with intrinsically 110° deflection", Electronic Application Bulletin, 33; 2, pp. 75–89. As a result of the strong pin-cushion-shaped and barrel-shaped deflection fields, each electron beam, after deflection, is flattened so that an elliptical target is formed on the display screen. This is termed deflection defocusing (defocusing of the electron beams as a result of the deflection). In order to obtain a good dynamic convergence, which means that the frames of the three electron beams coincide on the whole display screen, it is stated in this publication that it is possible, in principle, to provide the end of the electron gun with correction elements for the local deformation of the deflection field so as to remove the coma error in the dynamic convergence. However, this method does not provide a solution to reduce the effects of the deflection defocusing.

German Patent Application No. 2545718 laid open to public inspection which corresponds with U.S. Pat. No. 4,057,747, also discloses a color display tube in which such correction elements are used. In one of the embodiments described, each electron beam is passed between two strips of a material having a large magnetic permeability. These strips are provided at the end of the electron gun, above and below each electron beam and symmetrically with respect to the plane through the beam axes. In the operating display tube, said strips are situated in the magnetic deflection or convergence fields and deform the field locally so that it becomes barrel-shaped. As a result of this, according to this Patent, the coma error in the dynamic convergence and the deflection defocusing upon deflecting in the horizontal direction are reduced. No solution is given for the deflection defocusing upon deflecting in the vertical direction and the extra deflection defocusing on the picture diagonals. This defocusing is very annoying.

SUMMARY OF THE INVENTION

It is therefore an object of the invention to produce such a deformation of the deflection field on the neck side by means of correction elements that the effects of the deflection defocusing is reduced simultaneously and strongly both in the horizontal and in the vertical direction.

According to the invention a display tube of the kind described in the first paragraph in which this is the case is characterized in that the correction elements deform the first deflection field on the neck side adjacent each electron beam in a barrel-shaped manner, and deform the second deflection field on the neck side adjacent each electron beam in a pin-cushion-shaped manner so that the effects of the deflection defocusing on the display screen are considerably reduced. As already stated, the deflection field on the display screen side is strongly pin-cushion-shaped in one direction and is strongly barrel-shaped in the other direction. Said deflection fields deform the electron beams, which deformation increases quadratically with the deflection. Upon deflection in a display tube according to the invention, the deflection field which is pin-cushion-shaped on the display screen side is deformed to the barrel-shaped on the neck side adjacent each electron beam and the deflection field which is barrel-shaped on the display screen side is deformed so as to be pin-cushion-shaped on the neck side near each electron beam. Since upon deflection the beams between the correction elements are already moved to a small extent, a deformation of the deflection fields compensating for the deformation of the electron beams on the display screen side takes place. This will be explained hereinafter.

The local deformations of the deflection fields by means of correction elements can be produced in a number of manners.

A first preferred embodiment of the invention is one in which, for each, two curved or bent correction elements consisting of metal strips are provided which are situated in Euclidean planes parallel to the beam axes, said strips surrounding the electron beam partly and intersecting the plane through the beam axes which is also a plane of symmetry of said elements. Structurally this embodiment is very simple. The attenuation of the vertical deflection field is small in this construction (see also FIG. 11).

A second preferred embodiment of the invention is one in which the pin-cushion-shaped and the barrel-shaped deformations are obtained by four correction elements consisting of metal strips which are placed around each electron beam and extend away from the electron beam, said elements being situated at least partly in Euclidean planes situated parallel to the beam axis and symmetrically with respect to the plane through the beam axes. The attenuation of the horizontal deflection field is small in this construction. Dependent on the construction of the deflection coils and the associated configuration of the deflection field, a choice can be made advantageously from the first and second embodiments.

In order to be able to influence the mutual ratio of the intensities of the pin-cushion-shaped and barrel-shaped field deformations, moreover near at least one of the electron beams, two correction elements consisting of metal strips may be situated symmetrically with respect to the beam axis in a plane comprising the relevant beam axis and situated perpendicularly to the plane through the beam axes.

A third preferred embodiment is one in which the pin-cushion-shaped deformation per beam is obtained by four correction elements consisting of metal strips which are situated substantially symmetrically with respect to the relevant beam axis in planes parallel to the plane through the beam axes, and the barrel-shaped deformation per beam is obtained by two correction elements consisting of metal strips which are situated symmetrically with respect to the beam axis and in a plane perpendicular to the plane through the beam axes which moreover comprises the relevant beam axis. In all the preferred embodiments described the correction elements of the outermost electron beams, situated on the side of the central electron beam, may form one assembly with the correction elements of the central electron beam so that a simplification of the construction is obtained.

DESCRIPTION OF THE DRAWINGS

The invention will now be described in greater detail with reference to the drawings in which.

DESCRIPTION OF THE PREFERRED EMBODIMENTS

Figure 1:
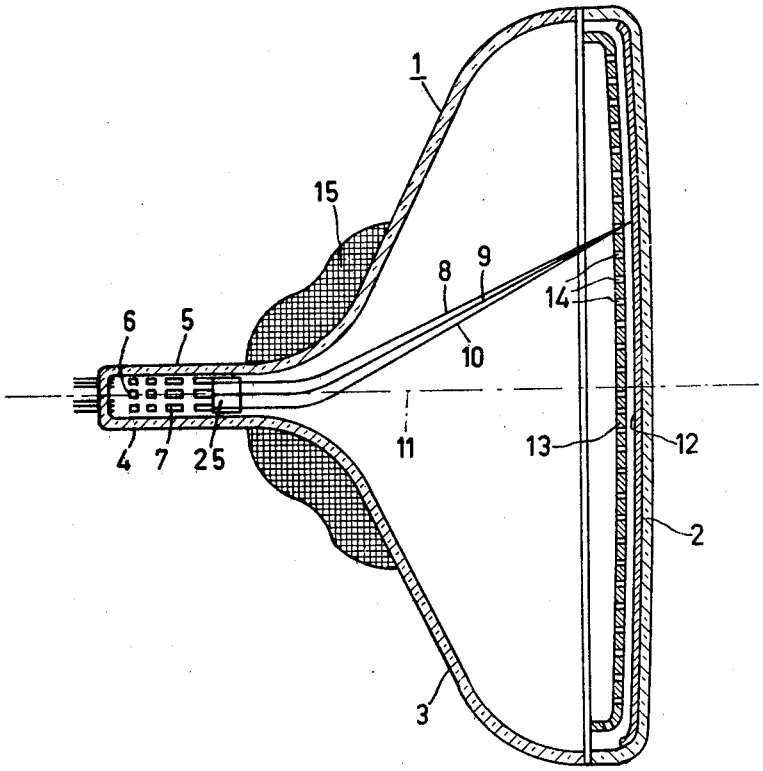
FIG. 1 is a diagrammatic horizontal sectional view of a display tube according to the invention.
Figure 3:
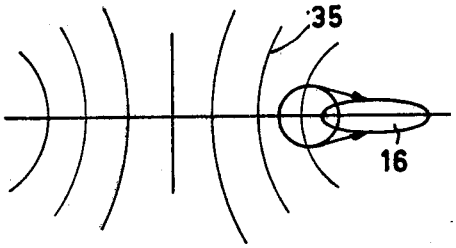
FIG. 3 shows the deformation of an electron beam in a deflection field which is pin-cushion-shaped on the display screen side.
Figure 5:
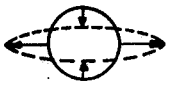
FIG. 5 shows diagrammatically the forces playing a part during the deformation.
Figure 4:
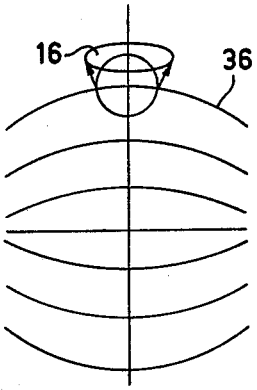
FIG. 4 shows the deformation of an electron beam in a deflection field which is barrel-shaped on the display screen side.

FIG. 1 is a diagrammatic horizontal sectional view of a display tube according to the invention. The color display tube comprises a glass envelope 1 which is composed of a display window 2, a cone 3 and a neck 4. Present in the neck 4 is a system of electron guns 5, 6 and 7 which produce the electron beams 8, 9 and 10. Prior to deflection the axes of the electron beams 8, 9, 10 are situated in one plane, the plane of the drawing. The axis of the central electron beam 9 coincides with the axis of the envelope 11. Opposite to the set of electron guns 5, 6, 7 on the inside of the display window 2, a display screen 12 is provided which is composed inter alia of a regular pattern of phosphor elements luminescing in three different colors. A shadow mask 13, having a very large number of apertures 14 through which the electron beams 8, 9 and 10 may pass, is positioned before the display screen 12. The electron beams 8, 9, 10 enclose a small angle with each other so that they each impinge only on phosphor elements of one color. Deflection coils 15 are provided around the transition neck-cone for deflecting the electron beams 8, 9, 10 in the horizontal direction (in the plane of the drawing) and in the vertical direction (perpendicular to the plane of the drawing). The horizontal deflection field on the side of the display screen 12 has a pin-cushion-shaped field distribution and the vertical deflection field on the side of the display screen 12 has a barrel-shaped field distribution in such manner that automatic convergence of the three electron beams 8, 9, 10 over the whole display screen 12 is obtained. In this case the three electron guns 5, 6, 7 are situated in a horizontal plane. It will be obvious that they may also be situated in a vertical plane, the horizontal deflection field obtaining a barrel-shaped field distribution on the side of the display screen 12 and the vertical deflection field obtaining a pin-cushion-shaped field distribution. Since upon deflection the electron beams 8, 9, 10 traverse the barrel-shaped and pin-cushion-shaped deflection fields eccentrically, deflection defocusing occurs. As shown in FIG. 3, the spot on the display screen 12 upon deflection is being overfocused vertically by the pin-cushion-shaped field 35 with simultaneously occurring underfocusing in the horizontal direction and, as shown in FIG. 4, said spot is elongated horizontally by the barrel-shaped field 36 with simultaneous overfocusing in the vertical direction. FIG. 5 shows diagrammatically (by means of arrows) the forces which act upon an electron beam upon deflection.

Figure 2A:
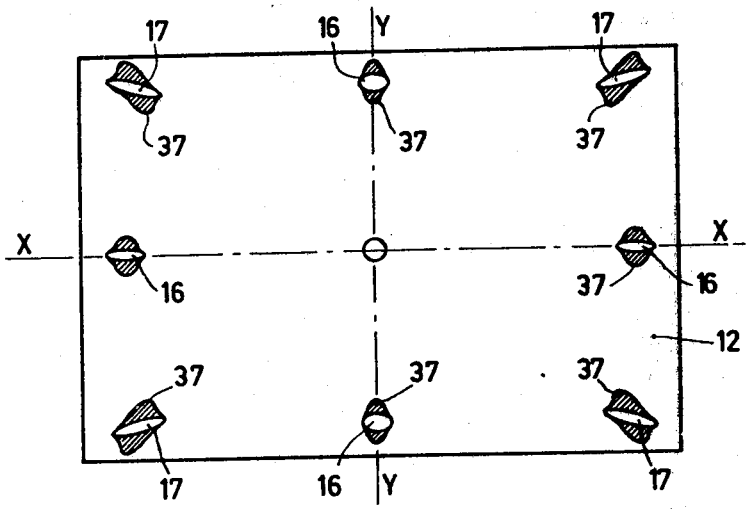
FIGS. 2*a* and 2*b* show the deformation of the target of the display screen, respectively without and with the use of the invention.

FIG. 2*a* shows diagrammatically a display screen 12 with spots. Both upon deflection in the horizontal direction and in the vertical direction, the deflection fields have an adverse effect on the electron beam, focusing too strongly in a vertical direction so that elliptical spots 16 and 17, each having a vertically emanating haze 37 (shaded), are formed. In the corners, these forces, which focus the beam too strongly, amplify each other so that at these areas the deflection defocusing is strongest and a spot 17 is formed. Said deflection defocusing can be reduced considerably by subjecting the electron beams to a deformation at the area where they leave the electron gun system 5, 6, 7, which deformation is opposite to the deformation by the deflection fields on the display screen 12 side. The mere use of a barrel-shaped correction field as described in U.S. Pat. No. 4,057,747 is insufficient for this purpose. In that case an extra deflection defocusing nevertheless occurs upon deflection in the vertical direction and towards the corners of the display screen. Upon deflection in the horizontal and vertical directions, the correction should take place simultaneously. This can be done by using the invention.

Figure 2B:
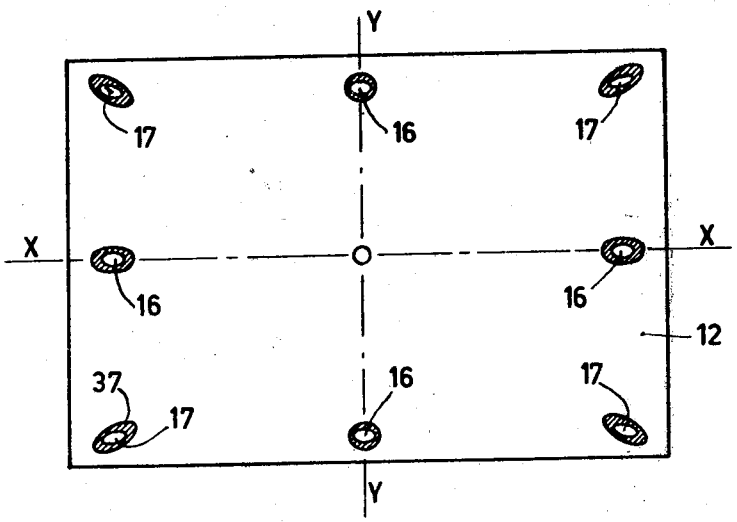

FIG. 2*b* shows a display screen 12 with spots of a tube in which the invention is used. The spots 16 and 17 are much less flattened while in addition the haze occurring in the vertical direction is considerably reduced.

Figure 6:
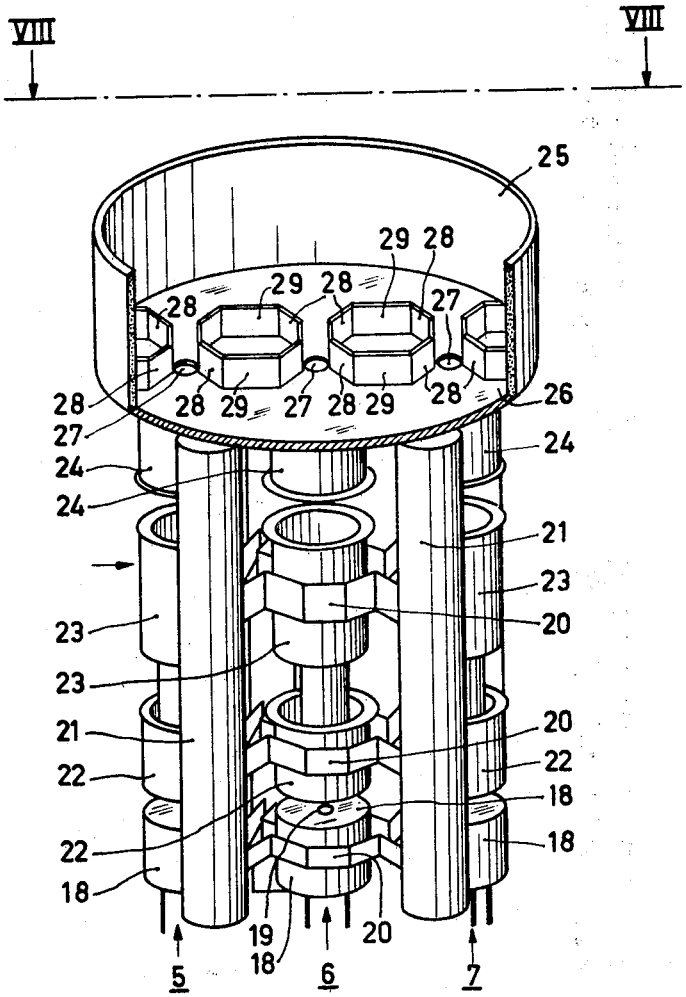
FIG. 6 is a perspective view, partly broken away, of an electron gun system for a display tube according to the invention.

FIG. 6 is a perspective view of an electron gun system as used in a display tube according to the invention. It consists of three separated guns 5, 6 and 7. However, it is also possible to use the invention in an electron gun system in which one or more of the corresponding gun electrodes form one assembly as described, for example, in U.S. Pat. No. 3,772,554. Each gun of FIG. 6 comprises a first grid 18 which has an aperture 19. Opposite to said aperture 19, the cathode (not visible) is provided in the first grid 18. Each gun furthermore comprises a second grid 22, a third grid 23 and a fourth grid 24. The grids 18, 22 and 23 are attached to glass rods 21 by means of metal strips 20. The grids 24 are placed against a common electrode 25 which has a base plate 26 with apertures 27 through which the electron beams 8, 9 and 10 (see FIG. 1) from the electron gun system emanate. Four correction elements consisting of four metal strips 28 having a large magnetic permeability are placed near each aperture 27 around each electron beam 8, 9, 10. These strips 28 are situated at least partly in Euclidean planes situated parallel to the beam axis and symmetrically with respect to the plane through the beam axis (the plane of the drawing of FIG. 1). The correction elements 28 of the outermost electron beams 8, 10 situated on the side of the central electron beam 9 form one assembly 29 with the correction elements of the central electron beam 9. Alternatively, however, four individual, not interconnected, strips may be provided per beam. In that case the correction elements are bent. It will be clear that these may also consist of curved strips 28. The strips are situated on the neck side of the deflection field of the deflection coils 15 (see FIG. 1) and generate there the desired pin-cushion-shaped and barrel-shaped field deformations which will be described in greater detail with reference to FIGS. 11 to 18 which are the result of calculations.

FIGS. 7 to 10 show a number of embodiments of correction elements with which both a pin-cushion-shaped deformation of one deflection field and a barrel-shaped deformation of the other deflection field can be obtained. These figures are elevational views of the common electrode 25 with the base plate 26 which has apertures 27 through which the electron beams 8, 9, 10 from the electron gun system emanate. The diameter of the common electrode is 23 mm. The distance between the central electron beam 9 axes and the outermost electron beam 8, 10 axes is 9 mm. The correction elements consist of metal strips 28 having a thickness of 0.15–0.50 mm of a material having a large magnetic permeability, for example Mu-Metal (75% Ni 5% Cu 2% Cr 18% Fe) or 45 Permalloy (45% Ni-55% Fe). The strengths of the field deformations can be optimised experimentally by varying a number of parameters, for example, the thickness of the strips 28, the distance to the electron beam axis, the length in the direction of the electron beam axis, the mutual distance, the magnetic permeability of the material of which the strips 28 are manufactured, and the position of the strips 28 in the deflection field.

Figure 7:
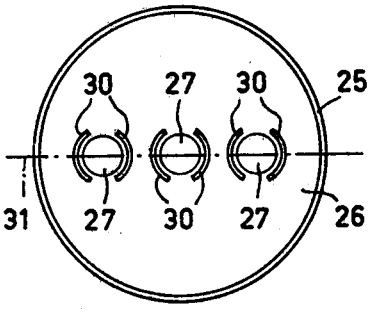
FIGS. 7 to 10 show a number of preferred embodiments of configurations of correction elements.

FIG. 7 shows diagrammatically a first preferred embodiment of the invention. Two curved metal strips 30 are provided for each electron beam and are situated in spatial planes parallel to the beam axis, surround the electron beam partly and intersect the plane through the beam axes. The plane through the beam axes is the plane perpendicular to the plane of the drawing comprising line 31. This plane is also the plane of symmetry of the elements 30. It will be obvious that such curved strips 30 can also be provided easily in the grids 24.

Figure 8:
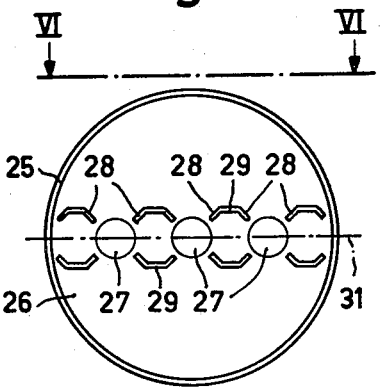

FIG. 8 shows analogously and diagrammatically a second preferred embodiment of the invention which is also shown in FIG. 6. The pin-cushion-shaped and barrel-shaped deformations of the deflection fields are obtained by four metal strips 28 arranged around each electron beam and extending away from the electron beam. The correction elements are perpendicular to the plane of the drawing and are situated symmetrically with respect to the plane through the beam axes. The correction elements of the outermost beams, which are situated on the side of the central beam, form one assembly 29 with the correction elements of the central beam.

Figure 9:
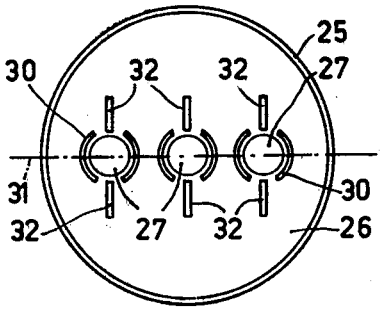

FIG. 9 shows an embodiment which may be compared with the embodiment shown in FIG. 7. In order to intensify the barrel-shaped field deformation with respect to the pin-cushion-shaped field deformation, the strips 32 are arranged above and below each electron beam. It is alternatively possible to use said strips 32 only for the central or for the outermost electron beams.

Figure 10:
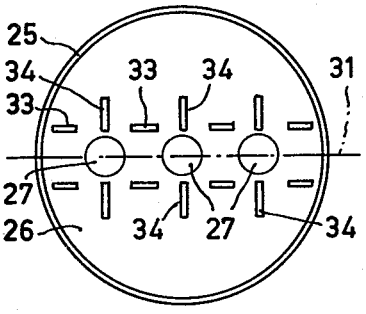

FIG. 10 shows a last preferred embodiment of a system of correction elements according to the invention. The pin-cushion-shaped deformation of the vertical deflection field (the field lines are horizontal) is obtained per beam by the Mu-metal strips 33 and the barrel-shaped deformation of the horizontal deflection field (the field lines are vertical) is obtained per beam by the Mu-metal strips 34. All strips 33, 34 are situated symmetrically with respect to the plane through the beam axes and extend perpendicularly to the plane of the drawing.

Figure 11:
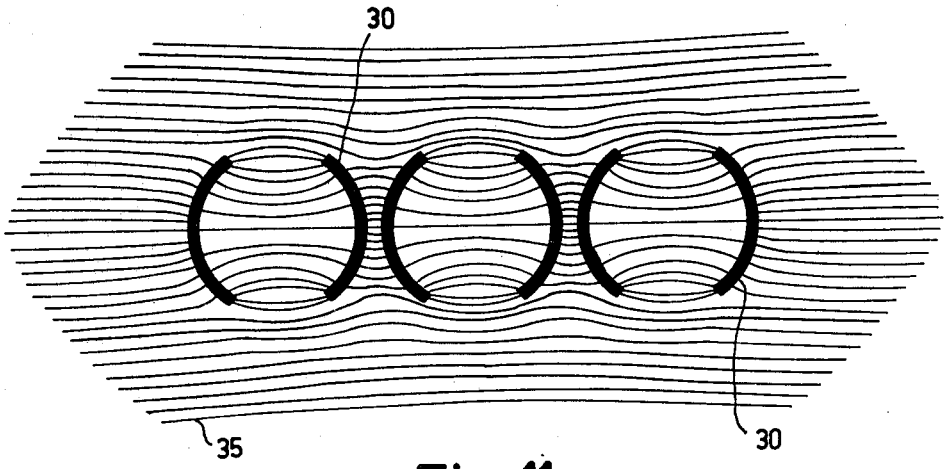
FIGS. 11 to 18 show the deformation of the horizontal and the vertical deflection fields by the correction elements.
Figure 12:
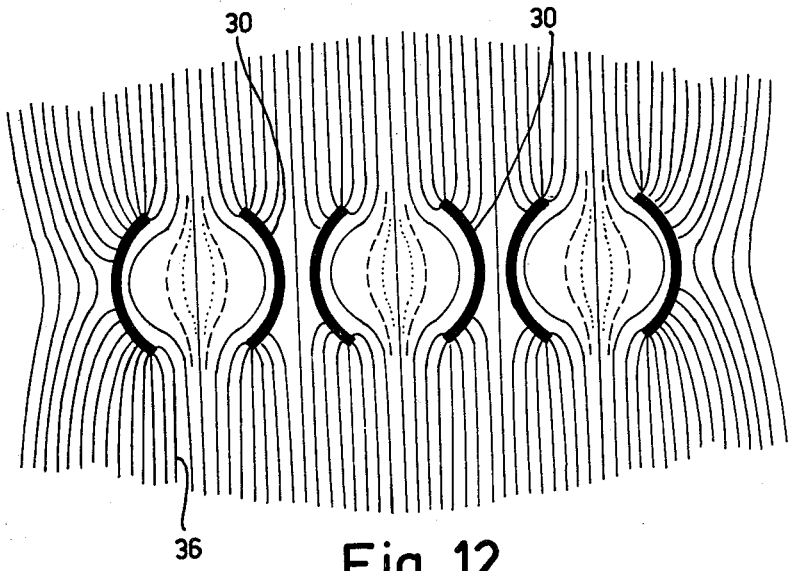

FIG. 11 shows that the strips 30, shown in FIG. 7 deform the vertical deflection field 35 at the area of the beam in a pin-cushion-like manner and FIG. 12 shows that the horizontal deflection field 36 is deformed in a barrel-shaped manner at the area of the beams.

Figure 13:
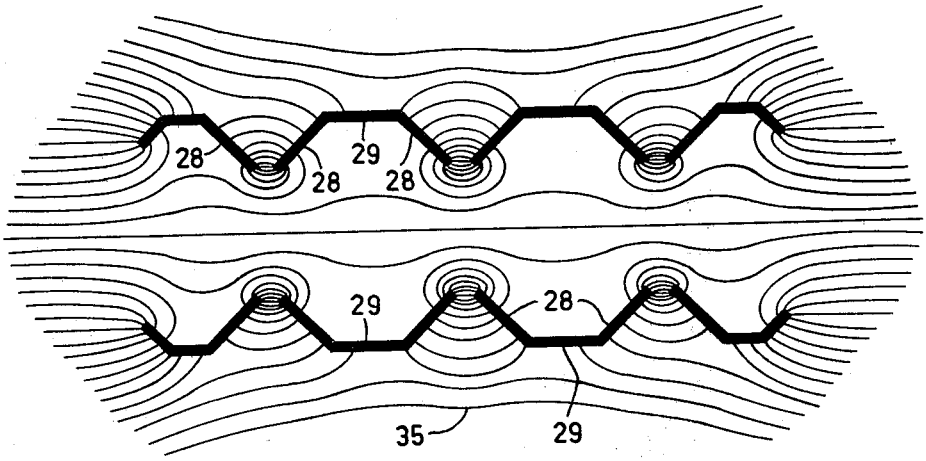
Figure 14:
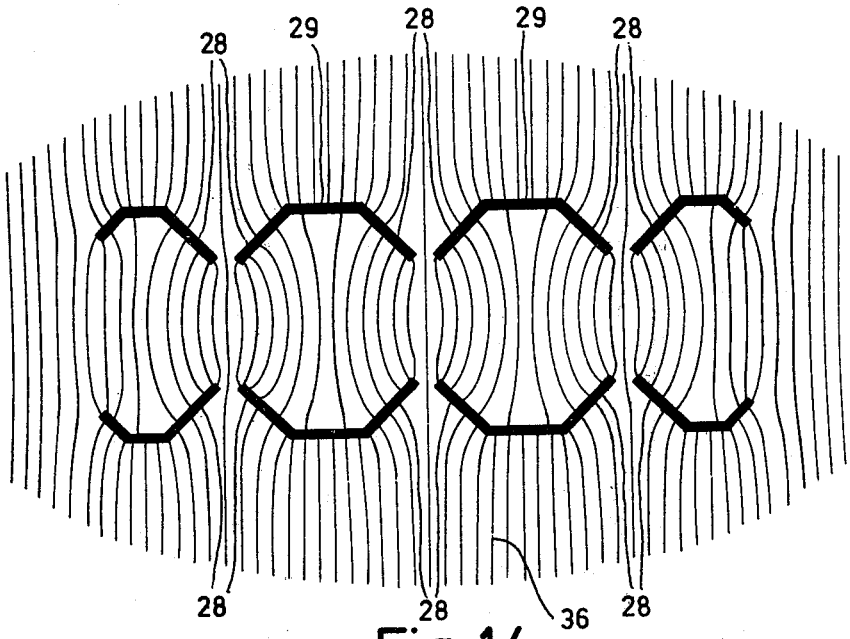

FIG. 13 shows analogously that the strips 28 and 29 shown in FIG. 8 deform the vertical deflection field 35 in a pin cushion-like manner at the area of the beams and FIG. 14 shows that the horizontal deflection field 36 is deformed in a barrel-like manner at the area of the beam.

Figure 15:
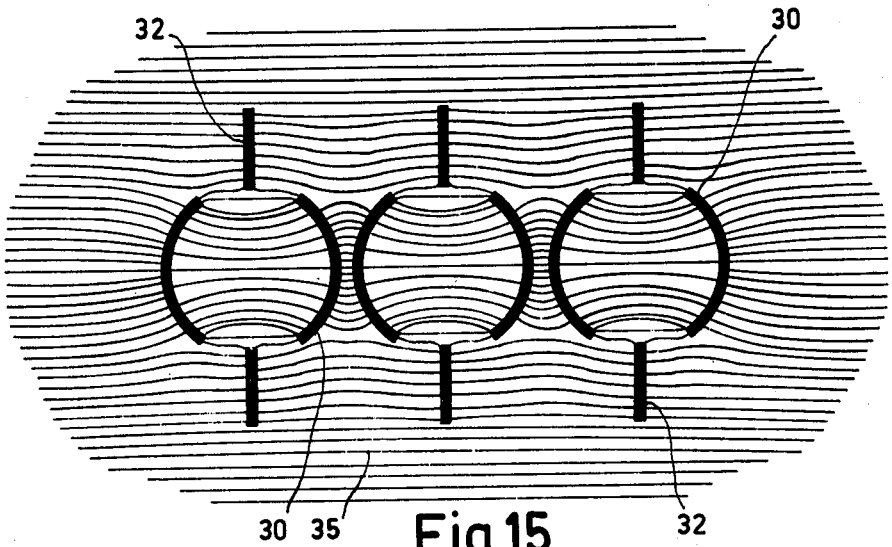
Figure 16:
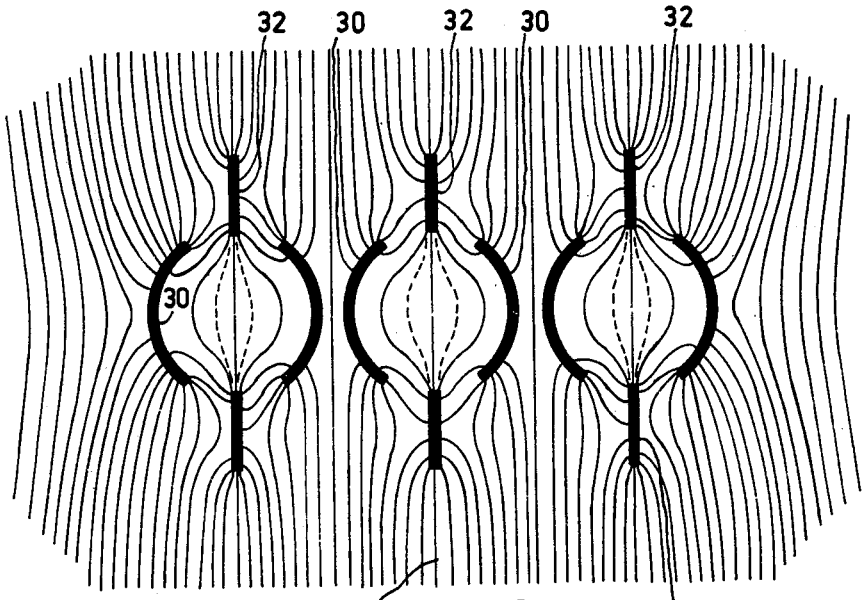

FIG. 15 shows that the strips 30 shown in FIG. 9 deform the vertical deflection field 35 (horizontal field lines) in a pin-cushion-like manner at the area of the beams and FIG. 16 shows that the horizontal deflection field 36 (vertical field lines) is deformed more strongly in a barrel-shaped manner at the area of the beams than with exclusively the strips 30 as shown in FIG. 11.

Figure 17:
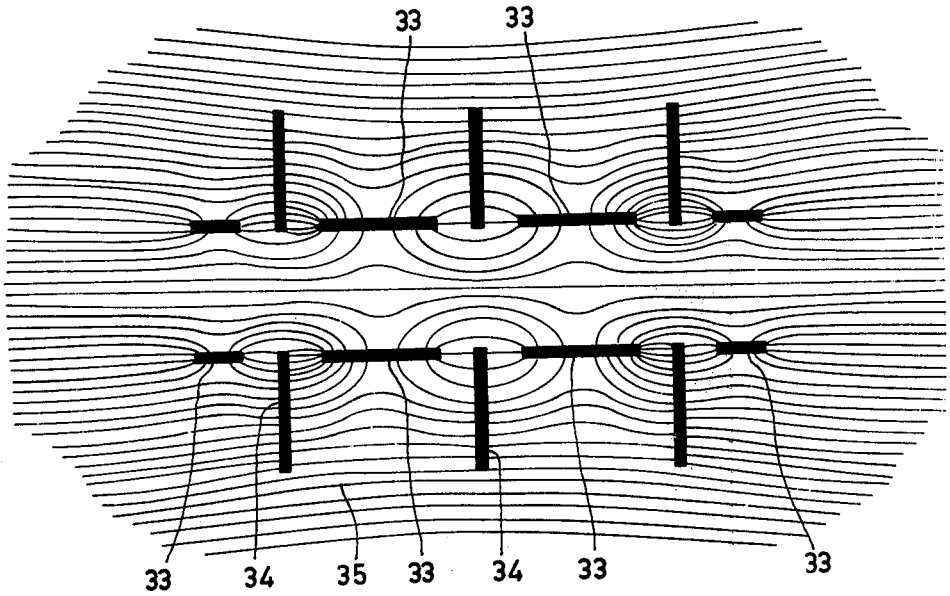

FIG. 17 shows that the strips 33 shown in FIG. 10 deform the vertical deflection field 35 in a pin-cushion-like manner at the area of the electron beams. The vertical strips 34 have substantially no influence thereon.

Figure 18:
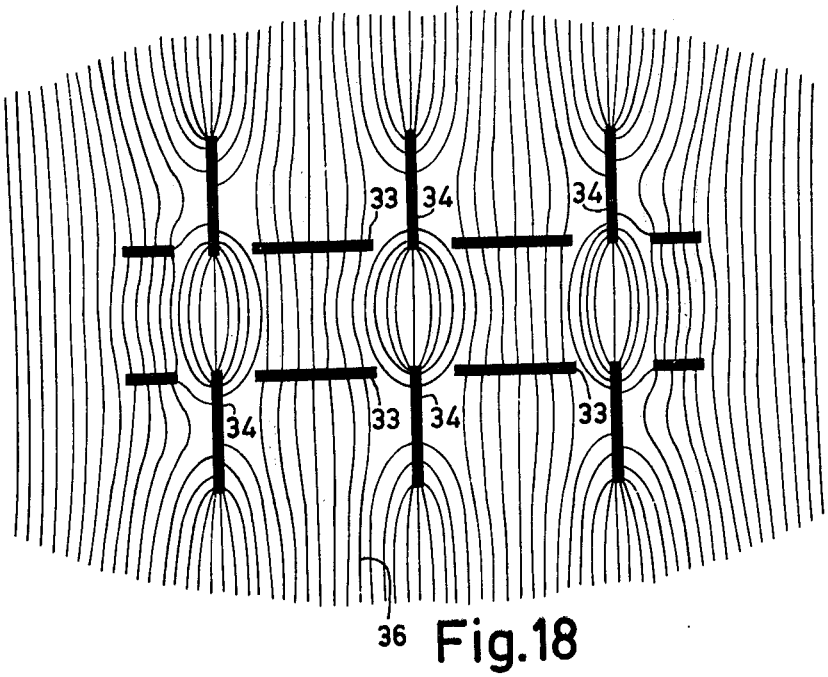

As shown in FIG. 18, the horizontal deflection field 36 is deformed in a barrel-like manner at the area of the electron beams by means of the strips 34. The extent of the deformation is also influenced by the mutual distance of the strips 34.

As already noted, the desired extent of field deformation can be obtained inter alia by an experimentally determined proportioning of the strips. It is possible by using the invention to considerably reduce the effects of the deflection defocusing in the horizontal direction and in the vertical direction, on the definition of the spot.

Haze, if any, occurring around the spot can be further reduced by using dynamic focusing by means of a voltage on the grids 23 varying with the deflection of the electron beams.

What is claimed is:

1. A display tube for displaying color pictures, said display tube comprising a display window, a cone attached to said display window, a neck attached to said cone, a display screen provided on the inside of said display window and consisting of a large number of regions luminescing in three different colors, means disposed in said neck for generating three electron beams, the axes of said electron beams being situated substantially in one plane, a color selection electrode positioned before said display screen for assigning each electron beam to luminescent regions of one color, and a system of deflection coils, disposed around the transition of the neck to the cone of the display tube, for generating a first and a second orthogonal deflection field, the first deflection field having a field distribution which is strongly pin-cushion-shaped on the display screen side, and the second deflection field having a field distribution which is strongly barrel-shaped on the display screen side, wherein said display tube further comprises correction elements placed near each electron beam for deforming the field distribution of the first deflection field, on the neck side near each electron beam, in a barrel-like manner and for deforming the field distribution of the second deflection field, on the neck side near each electron beam, in a pin-cushion-like manner whereby the effects of deflection defocusing on the display screen are considerably reduced in the vertical direction as well as the horizontal direction.

2. A display tube as claimed in claim 1, wherein two curved or bent correction elements consisting of metal strips are provided for each electron beam, which correction elements are situated in Euclidean planes parallel to the beam axes, said correction elements partly surrounding each electron beam and intersecting the plane through the beam axes which is also a plane of symmetry of said elements.

3. A display tube as claimed in claim 1, wherein the pin-cushion-shaped and barrel-shaped deformations are obtained by four correction elements consisting of metal strips which are placed around each electron beam and extend away from the electron beam, said correction elements being situated at least partly in Euclidean planes situated parallel to the beam axis and symmetrically with respect to the plane through the beam axes.

4. A display tube as claimed in claim 2 or 3, wherein, in addition near at least one of the electron beams, two correction elements consisting of metal strips are situated symmetrically with respect to the beam axis in a plane comprising the relevant axis and situated perpendicularly to the plane through the beam axes.

5. A display tube as claimed in claim 1, wherein the pin-cushion-shaped deformation per beam is obtained by four correction elements consisting of metal strips which are situated substantially symmetrically with respect to the relevant beam axis in planes parallel to the plane through the beam axes, and the barrel-shaped deformation per beam is obtained by two correction elements consisting of metal strips which are situated symmetrically with respect to the beam axis in a plane perpendicular to the plane through the beam axes which, in addition, includes the relevant beam axis.

6. A display tube as claimed in claim 3, wherein the correction elements of the outermost electron beams, situated on the side of the central electron beam, form one assembly with the correction elements of the central electron beam.

* * * * *